US007892117B2

(12) United States Patent
Tatham, Jr.

(10) Patent No.: US 7,892,117 B2
(45) Date of Patent: Feb. 22, 2011

(54) FIELD-SPORT GAME

(76) Inventor: William Tatham, Jr., 1026 Coast Village Rd., No. 88, Santa Barbara, CA (US) 93108

( * ) Notice: Subject to any disclaimer, the term of this patent is extended or adjusted under 35 U.S.C. 154(b) by 230 days.

(21) Appl. No.: 11/672,290

(22) Filed: Feb. 7, 2007

(65) Prior Publication Data

US 2007/0184922 A1 Aug. 9, 2007

Related U.S. Application Data

(60) Provisional application No. 60/766,722, filed on Feb. 8, 2006.

(51) Int. Cl.
*A63B 67/00* (2006.01)

(52) U.S. Cl. ..... 473/470

(58) Field of Classification Search ..... 473/470, 473/415, 513, 465, 471
See application file for complete search history.

(56) References Cited

U.S. PATENT DOCUMENTS

| | | | | |
|---|---|---|---|---|
| 4,905,970 | A * | 3/1990 | Holmsten et al. | 256/24 |
| 4,911,443 | A * | 3/1990 | Foster | 473/470 |
| 5,207,433 | A * | 5/1993 | Moore | 473/470 |
| 6,045,466 | A * | 4/2000 | Suess | 473/470 |
| 6,283,879 | B1 * | 9/2001 | Eden et al. | 473/513 |

OTHER PUBLICATIONS

NPL Webpage, Port-a-Field, 2005,www.port-a-field.com/rugby.htm, 5 pages.*

NPL Webpage, Rugby's7, 2004,http://www.rugbysevenstrinidad.com/, 6 pages.*

NPL Webpage, TouchRugby, 2003,http://rugbipensador.files.wordpress.com/2008/04/touchrugbybooklet.pdf, 10 pages.*

NPL Webpage, RugbyFieldLayout, Publication Date Unknown,http://www.athleticfieldmarker.com/RugbyField.html/, 3 pages.*

Rules of the Game,1990,St. Martin's Griffin,pp. 156-159.*

Rugbycompletelaws,International Rugby Playing Rules—2008, 2008,179 pages.*

Webpage download, 2002Manchester, 2002,http://m2002.thecgf.com/Sports/Rugby_7s/Rules/default.asp,1 page.*

United States Soccer Federation—Indoor Playing Rules, unknown publication date, 39 pages.*

Webpage download, ArenaFootball, 2000-2009,http://web.archive.org/web/20000301230016/www.arenafootball.com/rules.cfm, 8 pages.*

Webpage download, WorldArenaRugby, 2000-2009, http://web.archive.org/web/20000301230016/www.arenafootball.com/rules.cfm, 17 pages.*

(Continued)

*Primary Examiner*—Gene Kim
*Assistant Examiner*—M Chambers
(74) *Attorney, Agent, or Firm*—Kelly Lowry & Kelley, LLP

(57) ABSTRACT

A field-sport game modifies various aspects of rugby so as to be more appealing to the American audience. The playing field is substantially reduced in size, altering the strategy and play of the game. Moreover, walls may be provided in place of sidelines so as to eliminate out of bound rules. Alternatively, walls may be provided at opposite ends of the field which define in-goal areas to be touched by a ball in order to score.

12 Claims, 4 Drawing Sheets

OTHER PUBLICATIONS

Webpage download, Flickr, 2007, http://www.flickr.com/photos/falcon030/1448084917/in/photostream/,1 page.*
Webpage download, Rugby7, 2005, http://www.brandhk.gov.hk/brandhk/events/en/2005_seven.htm,4 pages.*
Webpage download, DURANGO, 2005, httphttp://web.archive.org/web/20041107094158/http://www.mindspring.com/~dansteuer/boot.htm,3 pages.*
Webpage download, Ultimate, 2001, http://ftp.cs.rochester.edu/~ferguson/ultimate/ultimate-simple.htm1,1 page.*
Webpage download, Rugby Referees' Forum, http://www.rugbyrefs.com/forums/view.php?pg=history,1 page.*
Webpage download, electronic Rugby, 2008, http://www.davesfootballblog.com/post/2008/02/21/the-swiss-army-knife/#comments, 1 page.*
Webpage download, Spectator guide to Rugby, publication date unknown, http://www.usarugby.org/media/EDocs/spec_guide2.pdf, 5 pages.*
Webpage download, Introduction to Rugby, publication date unknown,http://www.rugbyfootball.com/rugby_intro.html, 2 pages.*
Webpage download, port-a-field, publication date unknown,http://www.port-a-field.com/boot.htm, 3 pages.*
Webpage download, 2010 Rules, 2009,http://www.irblaws.com/downloads/EN/irb_law_book_2010_en.pdf, 196 pages.*
Webpage download, ombac, 2004, http://web.archive.org/web/20031204175618/ombac.org/ombac_rugby/rulesofrugby.htm, 9 pages.*

* cited by examiner

FIELD-SPORT GAME

RELATED APPLICATION

This application claims priority to U.S. provisional patent application Ser. No. 60/766,722, filed Feb. 8, 2006.

BACKGROUND OF THE INVENTION

The present invention generally relates to a field-sport game which is a modified version of rugby that can be played in indoor arenas.

The sport of rugby has its origins dating back to the nineteenth century. In the 1800s, formalities were introduced to football (soccer) rules in seven major public schools of England. Six of the seven schools were largely playing the same game. However, the seventh school, Rugby School, was playing a markedly different version of this game. The other schools moved ahead refining their rules and eventually their game became known as "association football" or soccer. The Rugby School's game developed differently and evolved over time into what is now known as rugby.

Although rugby is played in well over one hundred different countries, the major rugby playing countries where it is fairly popular primarily include only Great Britain, South Africa, New Zealand, Australia, and various South Pacific islands, including Western Samoa and Tonga. The rules can vary somewhat between the various countries, for example, there are certain rules and procedures, referred to as laws, recognized in Australia (Rugby League) that are somewhat different in Great Britain (Rugby Union). Rugby League is a break-away from Rugby Union, and thus it has slightly modified certain Rugby Union laws. For example, in Rugby Union there are two teams of fifteen players each, whereas in Rugby League there are two teams of thirteen players each. However, many of the laws and principles of the game are in common, and for purposes of this application the general term rugby will be used, referring to the Rugby Union laws.

Rugby is played on a field, called the pitch, with a length generally double the width. The maximum playing area is 158 yards by 77 yards on a grassy flat surface. Rugby is often played on soccer fields, which must be between 100 and 131 yards in length and 50 to 100 yards wide. The field, or pitch, includes end lines or goal lines at the leading edge of an in-goal area which may be between 10 and 20 yards in depth. Goals, "H-shape" cross bars, are located on each goal line, and are typically the same size as American football goal posts.

A typical adult-level Rugby Union match lasts for 80 minutes (two halves of 40 minutes each). An abbreviated game of rugby, called Sevens, consists of only 7 players playing on a full-sized field, with each half being only 7 minutes long. Scoring occurs with much greater regularity in Sevens, since the defenders are more spaced out than in Rugby Union.

Although rugby has a substantial following in many countries throughout the world, in the United States it is not widely followed. However, it is believed by the inventor that a modified form of rugby which can be played in indoor arenas and televised would gain a much greater following in the United States.

Accordingly, there is a continuing need for a modified rugby game which can be played on smaller fields and in indoor arenas, and which would appeal more broadly to the American audience. The present invention fulfills these needs and provides other related advantages.

SUMMARY OF THE INVENTION

The present invention resides in a field-sport game, and a method of playing the same, which includes variations to traditional rugby. The field-sport game of the present invention can be played on smaller fields, and is particularly adapted for play in enclosed arenas, such as those housing basketball and hockey games and the like.

The field-sport game of the present invention comprises a field having a first in-goal area defined in part by a first end line, and an opposing second in-goal area defined in part by a second end line. Preferably, the field includes line markers. First and second walls extend between the first and second in-goal areas, such that the walls run generally parallel to one another. Although the walls may extend only from end line to end line, more typically the first and second walls are provided around the entire perimeter of the field. The field is generally 60 yards in length from the first end line to the second end line, and generally 40 yards in width from the first wall to the second wall.

In one embodiment of the present invention, the provision of the walls eliminates out of bounds lines on a traditional rugby field. A first goal is associated with the first in-goal area. A second goal is in association with the second in-goal area. The first and second goals each include parallel vertical bars having a cross bar extending therebetween. Typically, the first goal extends upwardly from the first end line, and the second goal extends upwardly from the second end line, although the first and second goals can be associated with the walls, or placed between the wall and the end line.

A first team of players has as an objective to move the ball in their possession into and touching the field within the first in-goal area and/or drop-kicking the ball through the first goal to score points generally in accordance with the laws of rugby football. The ball is preferably a rugby football, that is, a ball having a general shape of a prolate spheroid. The first team taking possession of the ball advances the ball within the field of play towards the first in-goal area to score by running with the ball and lateraling or passing the ball backwards to teammates.

A second team of players has as an objective to prevent the first team of players having possession of the ball from moving the ball into and touching the field within the first in-goal area and/or drop-kicking the ball through the first goal and scoring. The second team prevents the first team from scoring by tackling a player of the first team in possession of the ball and/or attempting to obtain possession of the ball from the first team so as to advance the ball towards the second in-goal area to score generally in accordance with the laws of rugby.

In a particularly preferred embodiment, the first and second team of players each includes seven players, wherein the first and second teams play generally in accordance with the laws of Rugby Sevens other than the fact that there is no out of bounds due to the placement of the first and second walls surrounding the playing field.

In a second embodiment, the goals are associated with the first and second walls, typically disposed immediately adjacent thereto. The first and second walls define first and second in-goal areas. The first and second teams advance the ball, or defend against the advancement of the ball, towards the opposing first or second wall with an objective to score by either drop-kicking the ball through the goal or touching the ball against the first or second opposing wall. The field dimensions are preferably the same as mentioned above, namely, generally 40 yards between the first and second walls, and 60 yards between the first and second end lines. In this embodiment, the first and second end lines define out of bounds, which are governed by the laws of rugby, and more particularly the laws of Rugby Sevens.

In the second embodiment, given the short distance between the in-goal scoring areas, defined by the first and second walls, during kicking-off of the ball, such as to start play, the kicking team is penalized if the ball is kicked over the opposing first or second wall. Typically, the penalty is granting the non-kicking team possession of the ball at a mid-field marker of the playing field.

In yet further embodiments of the invention, the playing field is not surrounded by walls. Instead, when the length of the field from end line to end line is sixty yards, there are sidelines spaced forty yards apart from one another, and the game is otherwise played in accordance with the rules of Rugby Sevens with only minor changes, such as placement of kick-off, to accommodate for the much smaller field. When traversing the forty-yard length of the field, the width of the field being sixty yards, the walls are replaced by end lines which define the entrance to the in-goal area.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention resides in a field-sport game, and method of playing the game.

Figure 1:
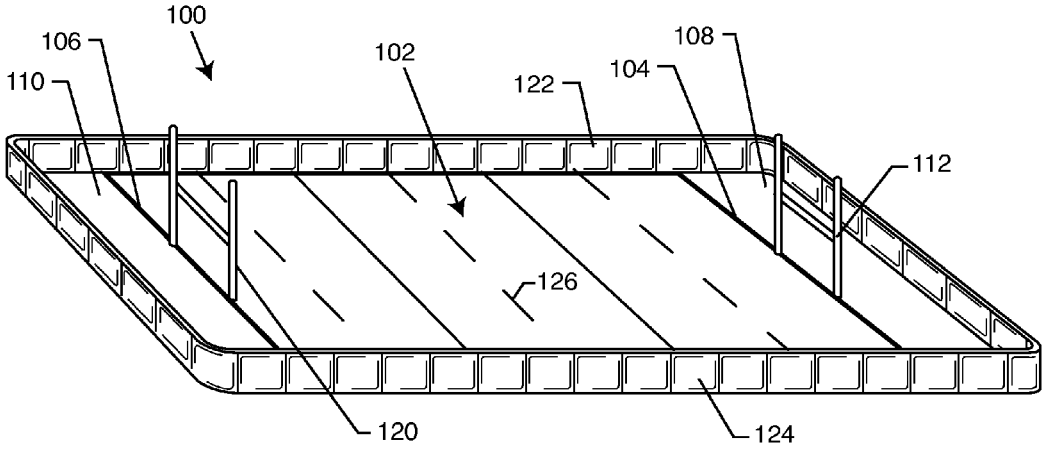
FIG. 1 is a perspective view of a playing field arrangement, in accordance with a first embodiment of the present invention.
Figure 3:
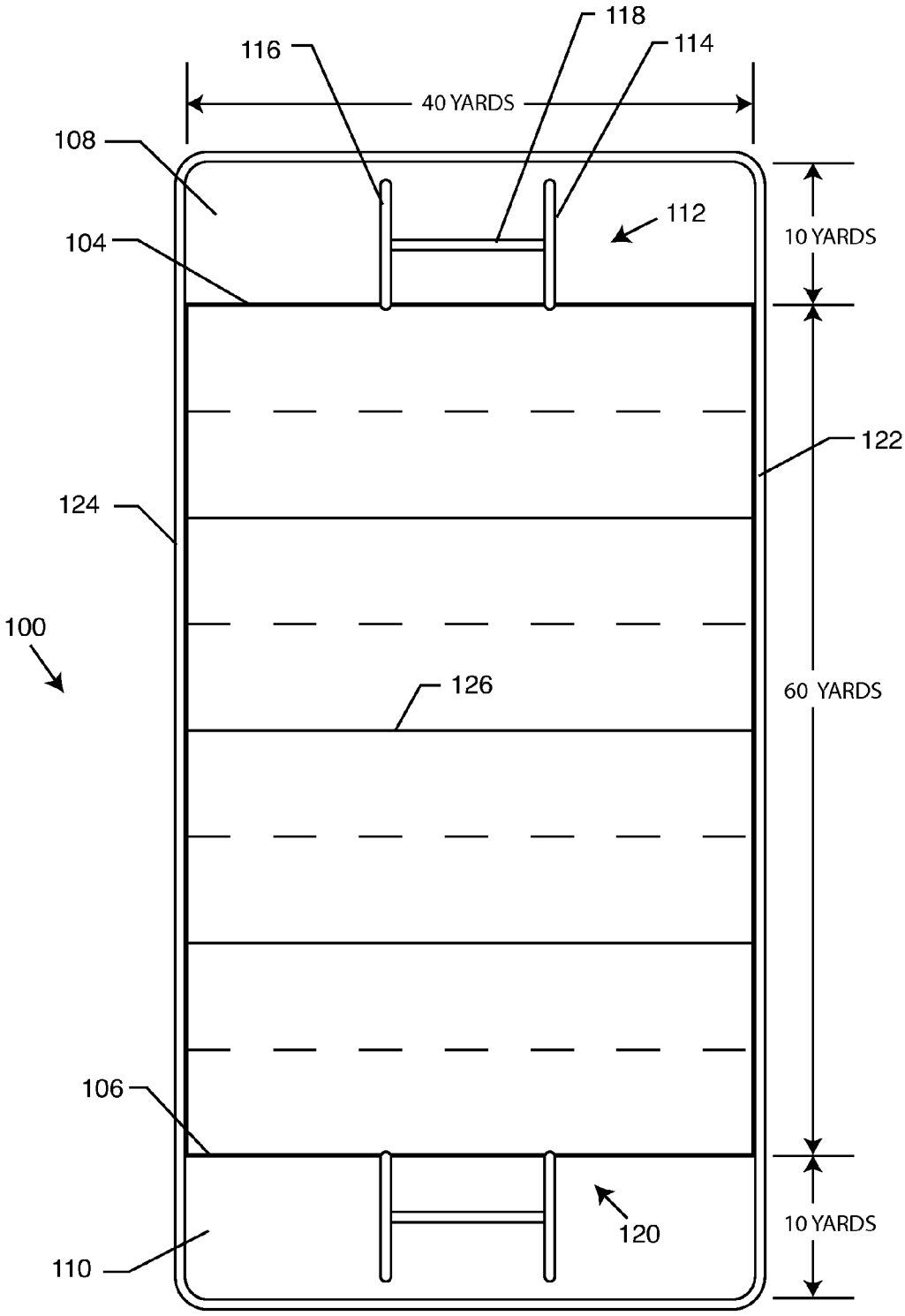
FIG. 3 is a top elevational and diagrammatic view of the playing field arrangement of FIG. 1, illustrating preferred dimensions thereof.

With reference to FIGS. 1 and 3, a playing field 100 used in accordance with the invention is illustrated. The playing field 102 itself is typically comprised of natural turf, or an artificial turf. As illustrated in FIG. 3, the preferred dimensions of the field 100 is 40 yards by 80 yards. This enables the field-sport game of the present invention to be played in many more locations than traditional rugby, which is typically played on an international soccer-sized field which is typically 50 to 100 yards wide and 100 to 130 yards in length. More importantly, the dimensions of the playing field 100 of the present invention enable the game to be played in indoor arenas which house basketball games, hockey games and the like. This enables the field-sport game of the present invention to be played in a large number of arenas across the United States, even during inclement weather. Playing in an indoor arena also provides other advantages, such as already provided stadium seating, with fans seated very close to the playing field 100. Moreover, it is easier to provide television coverage of the game in such arenas. Although the field sport game of the present invention is particularly adapted for use in indoor arenas, it will be appreciated that the game is not limited to such, and instead can be played in outdoor environments as well. In such a case, the field may include walls, or may be played without walls and slightly different rules so as to accommodate the lack of walls, as will be more fully described herein.

The turf field 102 itself is approximately 80 yards in length. First and second end lines 104 and 106 run generally parallel with one another and are spaced approximately 60 yards apart. The end lines 104 and 106 define the leading edge of first and second in-goal areas 108 and 110. Preferably, the in-goal areas, which are similar to an American football end zone, are approximately 10 yards in depth and 40 yards in width.

A first goal 112 is placed in association with the first in-goal area 108, typically extending upwardly from the first end line 104. The first goal 112 includes vertical bars or posts 114 and 116 generally parallel with one another, and a cross bar 118 extending therebetween. Such goals or goal posts are similar to that provided in traditional rugby and American football. A second goal 120 of similar configuration is associated with the second in-goal area 110, typically extending upwardly from the second end line 106. However, it will be appreciated that the first and second goals 112 and 120 can be placed at any position within the in-goal area 108 or 110. For example, it may be preferable to place the first and second goals 112 and 120 at the rear end of the in-goal area 108 and 110, respectively, such that the goals 112 and 120 are associated with the respective first or second wall extending along the back of the in-goal area. This could be done as a safety precaution for the players, as well as the perception of an open field of play for better viewing and television production.

In traditional rugby, there are sidelines which run the length of the playing field which define out of bounds. When a player runs out of bounds, or is tackled out of bounds, there is a set procedure for resuming play. Moreover, in traditional rugby, it is not uncommon for a team in possession of the ball to kick the ball forward and out of bounds. Although this turns the ball over to the opposing team, it significantly advances the ball forward, and thus this is used as a strategy. However, the inventor believes that these out of bounds rules significantly slow down the game and are very foreign to the American audience. Accordingly, first and second walls 122 and 124 run parallel to one another at opposite sides of the field. These walls 122 and 124 extend at least between end lines 104 and 106, and more preferably encircle the entire playing field 102 such that there are no out of bounds. A player running into one of the walls 122 or 124 can continue to move forward, unless tackled. The tackle is treated as if the player were tackled in the playing field area, instead of out of bounds. The walls 122 and 124 may be padded to prevent injury to the players. It is believed that the provision of the walls 122 and 124, as well as the smaller size of the field, will speed up the game and render it more understandable and appealing to the American audience.

The field 102 itself typically has a plurality of line markings 126 formed thereon for various purposes, including the placement of the ball in penalty situations, to assess the progress of an offensive team in possession of the ball, for kick-offs, and the like.

With the exception of the no out of bounds rules and the smaller field, the field-sport game of the present invention is generally played in accordance with the laws or rules of traditional rugby.

As indicated above, in Rugby Union, each team has fifteen players on the field of play. Players numbered 1-8 are forwards, while players numbered 9-15 are backs, whose main role is to exploit possession of the ball that is won by the larger forwards. Given the relatively small size of the playing field 100 in the game of the present invention, the game of the present invention preferably has seven players for each team, and is played in accordance with the laws of Rugby Sevens, which is a variant of Rugby Union in which only seven players per side or team play, instead of the full fifteen. Rugby Sevens is sanctioned by the International Rugby Board (IRB), and is played under substantially the same rules and with the traditional Rugby Sevens game is played on a field of the same dimensions as the fifteen-player game. While a normal Rugby Union match lasts upwards of 80 minutes, a normal Rugby Sevens match lasts approximately 15 minutes (allowing for the one-minute halftime break, injury time, etc.) The field-sport of the present invention could adopt the Rugby Sevens competition finals time period, lasting somewhat more than 20 minutes, each half in a competition final being 10 minutes instead of the normal 7 minutes. The full laws which apply to Rugby Sevens can be found at www.irb.com, the contents of which are incorporated by reference herein, and the rules as they apply to the field-sport game of the present invention will be described herein generally.

In a particularly preferred embodiment, a traditional rugby football is used. The ball is typically made of leather, or some other synthetic material, that is easy to grip but does not have laces. Rugby balls are generally of a prolate spheroid shape, or in other words oval in shape and rounder and less pointed than American footballs, to minimize erratic bounces. Although a traditional rugby football, such as that approved by the International Rugby Board, is the preferred ball used in accordance with the game of the present invention, it will be appreciated that other balls, such as a traditional American football could also be used.

The game of the present invention is started with a kick-off to the opponent from an assigned field marker line 126. While in traditional rugby, this is done from mid-field, given the small size of the playing field 100 of the present invention, this is typically done closer to the end line 104 or 106, such as the ten or twenty yard line. Any player of either team may gain possession of the ball, in accordance with the rules of rugby. When running with the ball, players may continue to run until they are tackled, or run beyond the goal line, and touch the ball on the field turf 102 in the in-goal area 108 or 110, which results in a score or a try. This typically results in a score of five points, although it will be appreciated that the name of such a score and the number of points granted for the score can be modified, such as being called a touchdown worth six points so as to be more similar to American football. A conversion attempt may be made by retreating from the in-goal area 108 or 110 a predetermined distance directly behind the area in which the score or try was made, and then drop-kicking the ball through the goal 112 or 120 for additional points. Typically, as in rugby, the successful after-try kick is worth two points, although it may be modified, such as a single point similar to traditional American football.

While the team has possession of the ball and is advancing towards their opposing in-goal area 108 or 110, the ball may be passed to any other player, however, it may only be passed laterally or backward, never forward. Moreover, any player may kick the ball forward at any time. Once the ball is kicked, players of either team, regardless of whether or not the ball hits the ground, may gain possession. Often times, the ball is kicked in an effort to advance it or obtain relief from poor field position. There is no blocking in rugby, and any player may carry, pass or kick the ball. The ball carrier must release the ball when tackled and roll out of the way so that other players on their feet can play the ball.

After the referee has whistled a minor law violation, a bound group of players from each team form a tunnel with the opposition. The non-offending team puts the ball into the tunnel by rolling it into the middle and each team pushes forward until one player is able to hook the ball with the feet and push it to the back row of players on his or her team. This is what is referred to as a scrum. Similar to Rugby Sevens, scrums consist of three players per team.

After a serious infringement of the law, or rules, offenders are required to retreat ten yards while the opposing team is given the opportunity to restart play unopposed. Players may kick the ball up field to gain field advantage. If in range, the non-offending team may attempt to kick at the goal post, worth three points. Other less serious infringements of the law result in free kicks, sending a player to the Sin Bin for a specified period of time, banning the player from the game known as a Send-Off, etc. In the game of the present invention, players sent to the Sin Bin or banning the player from the game may either result in one team having fewer players than the opposing team, either for the remainder of the game when the player is Sent Off, or for a period of time such as when a player is sent to the Sin Bin. It is alternatively contemplated that the team with the penalized player be able to substitute in a new player such that there are always seven players on the field at any given time.

There is an off-side law in rugby, and in general play the ball creates the off-side line and players are not permitted to participate in play if they are on the opposing team's side of the ball. One cannot participate in the game from an off-side position. At a scrum, the off-side lines are drawn across the field through the feet of the last person in each team's scrum.

Players carrying the ball may be stopped by being tackled by the opposing team. Usually, players may only be tackled around the waist and legs for safety purposes. The player must release the ball and roll away from it to allow other players on their feet to play the ball. Supporting players from both teams converge over the ball on the ground, binding with each other in attempting to push the opposing players backwards in a manner similar to a scrum. This situation is known as a ruck. The ball may not be picked up by any player until the ball emerges out of the ruck. A Maul is formed with a similar gathering of players, except the player in possession of the ball is not brought to the ground or tackled, but held up by an opponent as players converge on him. A Ruck or Maul situation creates off-side line laws.

There are four ways for a team to score points in rugby. Five points are awarded to a team for touching the ball down in the other team's in-goal area. This is called a Try. Following a Try, two points are awarded for a successful kick through the goal posts. Following a major law violation, the kicking team, if in range, has the option to "kick to points". Three points are awarded for a successful penalty kick. The kick must be from the point of the foul or anywhere on a line straight behind that point. The ball can be played if the kick fails. Three points are also awarded for a successful drop-kick, which can be taken from anywhere on the field at any time during the play. Once again, the ball is live if the kick fails.

Typically, the game is started with a coin toss, to determine which team will kick the ball off. The team then lines up on a predetermined line marker 126, such as the ten or twenty yard line, and kicks the ball off towards the opposing team. Usually, the ball must at least travel a predetermined distance, unless first played by an opponent. Otherwise, it is kicked off again, or a scrum formed at the center at the opponent's option. If the ball is kicked directly into the in-goal area or touch, the opposing team may accept the kick, have the ball kicked off again, or have a scrum formed at the center line. In the game of the present invention, in the event that the ball is kicked over the wall at the far end of the in-goal area, this can either be treated as the ball being kicked directly into the in-goal touch area, as described above, but more typically the ball is placed at a predetermined spot on the field as a penalty, such as the mid-field marker line. The ball is then advanced towards the first or second in-goal area 108 or 110, as described above. The opposing team plays defense, in accordance with the rules of Rugby Seven to prevent the first team of players having possession of the ball from moving the ball into and touching the in-goal area 108 or 110 and/or drop-kicking the ball through the goal 112 or 120. It is contemplated that a variation of this embodiment could be that the walls 122 and 124 could constitute the in-goal area themselves, such that the ball must be touched against these walls at the end of the in-goal area, or even moved to the end lines 104 and 106. Change of possession occurs generally in accordance with the rules of Rugby Seven.

Figure 5:
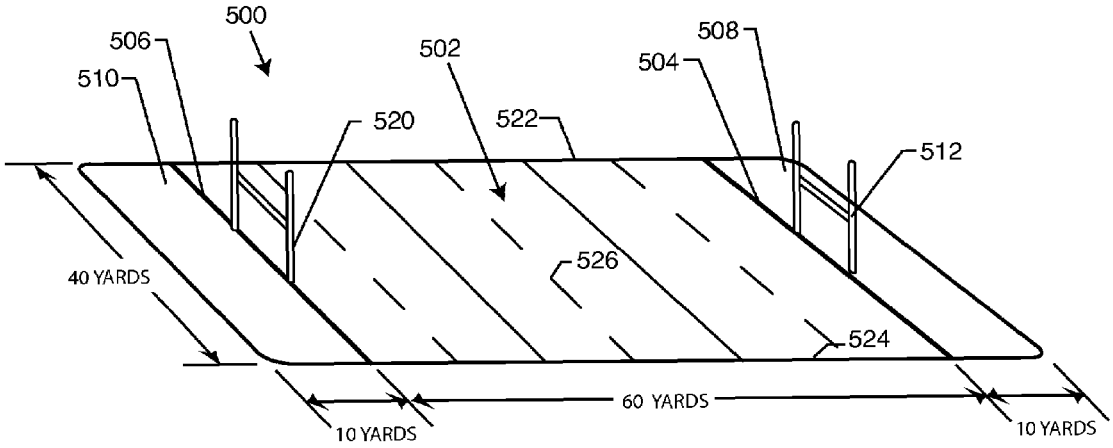
FIG. 5 is a perspective view of a playing field arrangement, similar to FIG. 1, but incorporating sidelines instead of walls.

With reference now to FIG. 5, another playing field arrangement is illustrated similar to that illustrated in FIGS. 1 and 3, but without the walls 122 and 124. The playing field 502 is arranged, otherwise, in a similar fashion. That is, there are end lines 504 and 506 which define the meeting edge of the in-goal area 508 and 510, respectively. There are also goals 512 and 520 either extending upwardly from the end line 504 and 506, or positioned anywhere within the in-goal area as deemed necessary. The field 102 also includes line markings 526, such as those needed to determine the progress of the advance of the ball, kick-off lines, penalty lines, mid-field lines, etc. The distance between the end lines 504 and 506 is sixty yards, and typically each in-goal area 508 and 510 are ten yards in depth. The field 102 is forty yards in width, and defined by generally parallel sidelines 522 and 524. Thus, the playing field 102 has a total dimension of forty yards wide by eighty yards in length, or approximately three thousand, two hundred square yards. This is much smaller than a traditional rugby field which is at least fifty yards in width and a hundred and twenty yards in length, or at least six thousand square yards in size.

To accommodate for the much smaller field, kick-offs are made closer to the end line 504 or 506, instead of at mid-field as in traditional Rugby Sevens. It is also contemplated that the style of play will be significantly different due to the much smaller field. For example, in traditional Rugby Sevens, it is desirable to kick the ball forward to advance the ball, even if the kicking team loses possession of the ball. However, in the field sport game of the present invention, given the much smaller field size, it is anticipated that such kicks to advance the ball will not be as common and strategically beneficial. It is also anticipated that there will be a large increase in scoring in the game of the present invention as the field is much shorter in length than width as compared to a traditional rugby field, decreasing the distance which must be traversed in order to score. Drop-kicking a field goal will also be easier and more commonplace.

Figure 2:
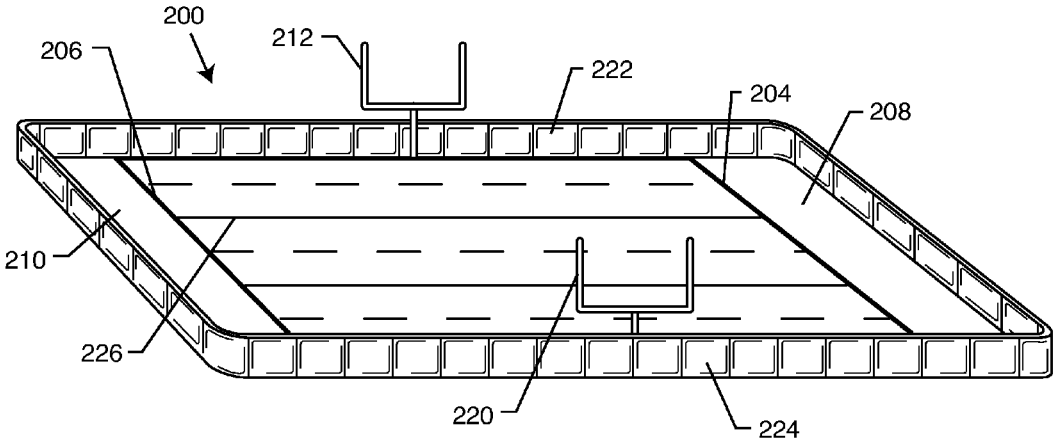
FIG. 2 is a perspective view of a playing field arrangement used in accordance with a second embodiment of the present invention.
Figure 4:
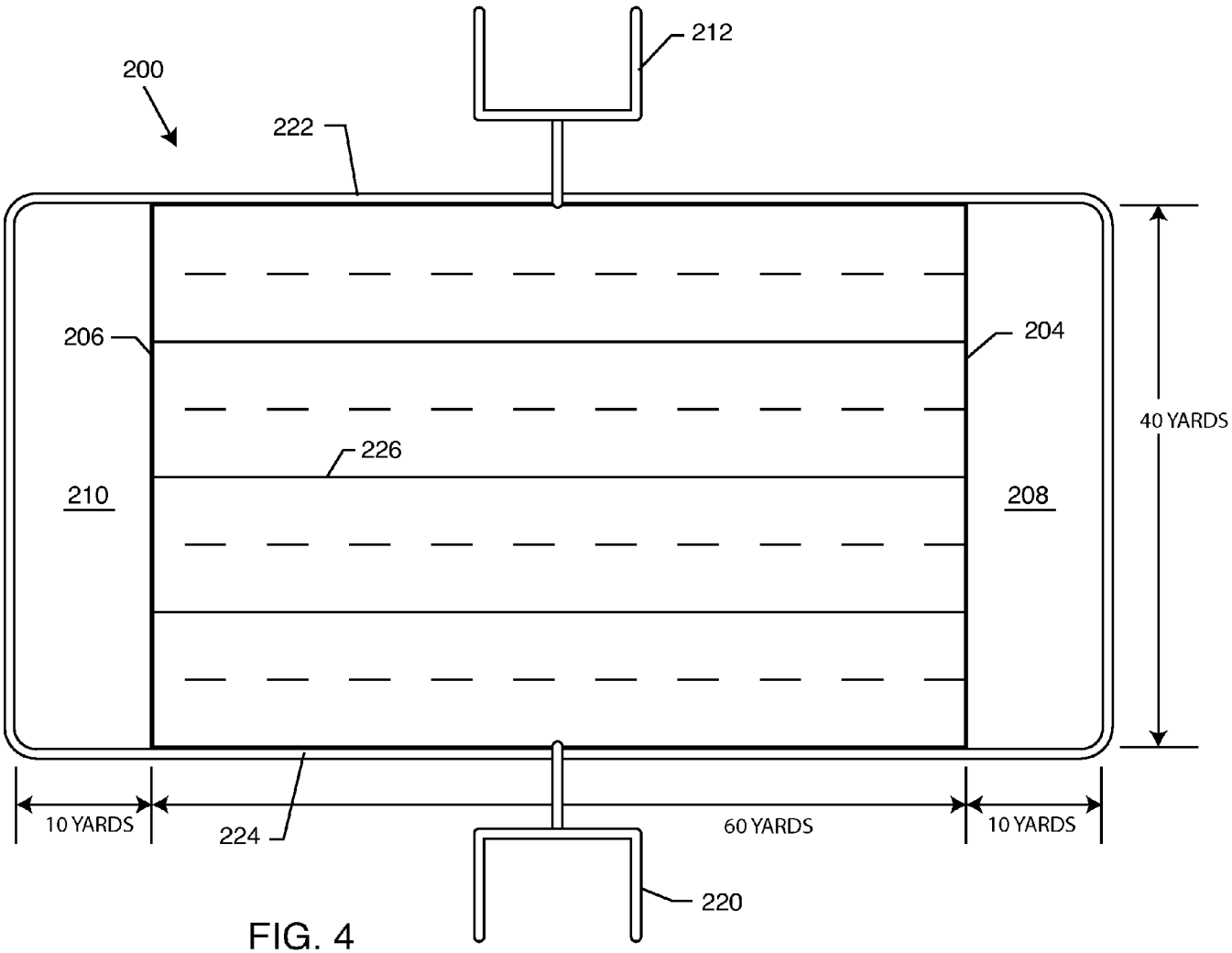
FIG. 4 is a top elevational and diagrammatic view of the playing field of FIG. 2, with preferred dimensions thereof.

With reference now to FIGS. 2 and 4, another embodiment of the field-sport game of the present invention will now be described. The playing field 200 is typically of the same dimensions as that described above, namely, 40 yards by 80 yards of total field. However, instead of playing lengthwise, in this version of the game of the present invention, the teams move the 40-yard distance between the walls 222 and 224. The inner surface of the walls themselves 222 and 224 define the first and second in-goal areas, a try being scored by touching the ball against wall 222 or 224. The goals 212 and 220 are moved from the end lines 204 and 206 to immediately adjacent to walls 222 and 224 at the center of the field 200. As illustrated in FIGS. 2 and 4, the goals 212 and 220 can be of either a Y-shape, more similar to American football, or of an H-shape, as illustrated in FIGS. 1 and 3. The important aspect is that a cross bar extends between two generally parallel and vertically extending posts or bars, as described above. Similarly, the goals 112 and 120 illustrated in FIGS. 1 and 3 can be of the Y-shape configuration.

The end lines 204 and 206 are still spaced apart by approximately 60 yards. However, in this case, they define out of bounds, with out of bounds areas 208 and 210 being provided. Thus, the out of bounds rules of Rugby Sevens come into play when stepping over the out of bounds 204 and 206. If the ball goes out of bounds, it is restarted with a line-out. Both teams form a line perpendicular to the touch line approximately three feet apart from one another. A player of the team not responsible for the ball going out of bounds calls a play and throws the ball in the air in a straight line between the two lines. Players of each team may be supported in the air by their teammates as they jump to gain possession of the ball.

It is contemplated by the present invention that the walls 222 and 224 be shortened such that there are no out of bounds, and a player may run into a wall or be tackled into a wall and treated as if it occurred on the field, as described above.

The line markers 226 extend generally parallel to the first and second walls 222 and 224, so as to define a mid-field marker, and other markers that are necessary for placement of the ball in given situations.

The game is played generally in accordance with the rules of Rugby Sevens, with a few variations to accommodate for the field 200 configuration and size. For example, when initially kicking off to start the game or after a score, the kicking team is penalized if it kicks the ball over the wall 222 or 224. Typically, the opposing team will be granted possession of the ball at the mid-field marker 226. Play then resumes, and generally in accordance with the rules of Rugby Sevens, as described above. Scores are given for field goals (three points), trys (or touchdowns), wherein the player touches the pertinent wall 222 or 224 (five or six points), and extra points or conversions (two or one point(s)). Once again, the end lines 204 and 206 typically serve as out of bound sidelines, with the traditional Rugby Sevens rules applying. A version of the game would eliminate these out of bound lines 204 and 206, and instead move the walls 222 and 224 inwardly such that it is played without any out of bounds rules, similar to that described above.

When making a field goal or a conversion, nets can be placed behind the goal posts 112, 120, 212 or 220, so as to capture the ball. However, in order to make the game more appealing, more typically there are no nets behind the goal post such that an audience member can obtain possession of a kicked ball as a memento and keepsake.

Figure 6:
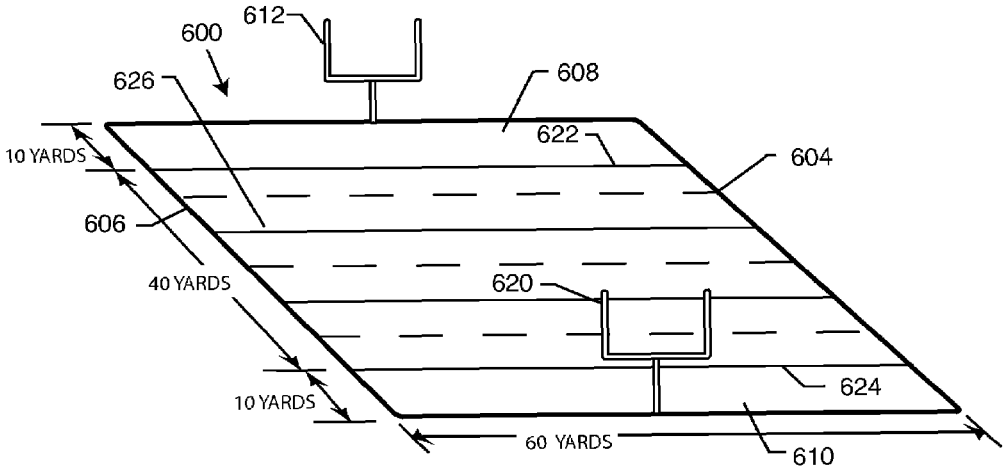
FIG. 6 is a perspective view of a playing field arrangement similar to that illustrated in FIG. 2, but without the surrounding walls.

With reference now to FIG. 6, a playing field 600 is illustrated which is similar to that of FIGS. 2 and 4, but without the surrounding walls 222 and 224. Instead, lines 622 and 624 define end lines or the leading edge of the in-goal areas 608 and 610 immediately behind them. The distance between end lines 622 and 624 is forty yards, similar to that described above. The goals 612 and 620 can be positioned at the end lines 622 and 624, or anywhere within the in-goal areas 608 and 610, as described above. Lines 604 and 606 define sidelines, or out of bound lines.

This version of the game is played generally in accordance with that described above with respect to FIGS. 2 and 4. However, instead of touching the ball against the wall 222 or 224 in order to score a try, the ball is touched in the in-goal area 608 or 610. If the ball is kicked out of the opposing in-goal area 608 or 610, a penalty is incurred and the ball is placed at a predetermined line marker, such as the mid-field marker, as described above.

It is believed that the field-sport game of the present invention, with its unique field configuration and modification of the Rugby Sevens laws, will be much more comprehensible to the American audience and much more exciting to watch. Playing the field-sport game of the present invention in existing indoor arenas provides venues with stadium seating or stands, vendors, music, scoreboards and monitors, etc. to enhance the overall experience. Moreover, televising the games in such an environment will be much easier.

Although several embodiments have been described in some detail for purposes of illustration, various modifications may be made without departing from the scope and spirit of the invention. Accordingly, the invention is not to be limited, except as by the appended claims.

What is claimed is:

1. A method of playing a game, comprising the steps of:

providing a field having a first wall defining a first in-goal area and an opposing and generally parallel second wall defining a second in-goal area, a first goal adjacent to the first wall, and a second goal adjacent to the second wall, the goals each including parallel vertical bars having a cross bar extending therebetween, and a first line defining an out of bounds extending between generally opposite ends of the first and second walls and a second line defining an out of bounds extending generally between opposite ends of the first and second walls;

providing a ball;

providing a first team and a second team of players;

the first team taking possession of the ball and advancing the ball within the field of play towards the first in-goal area to score by running with the ball and lateraling or passing the ball backwards to teammates so as to touch the ball onto the first wall defining the first in-goal area and/or drop-kicking the ball through the first goal; and the second team preventing the first team from scoring by tackling a player of the first team in possession of the ball and/or attempting to obtain possession of the ball from the first team so as to advance the ball towards the second wall defining the second in-goal area and/or drop-kicking the ball through the second goal.

2. The method of claim 1, wherein the providing a field step includes the step of providing a playing field that is at least 60 yards from the first line to the second line, and generally 40 yards from the first wall to the second wall.

3. The method of claim 1, wherein the providing first and second teams of players step comprises the step of providing seven players for each of the first and second teams.

4. The method of claim 1, including the step of kicking the ball off to start play, and penalizing the kicking team if the ball is kicked over the opposing first or second wall.

5. The method of claim 4, wherein the penalizing step includes the step of granting the non-kicking team possession of the ball at a mid-field marker of the playing field.

6. A method of playing a game, comprising the steps of:

providing a playing field approximately 40 yards in length and at least 60 yards in width;

providing a first vertical wall extending along the length of the playing field and defining a first in-goal area;

providing an opposing and generally parallel second vertical wall extending along the length of the playing field 40 yards from the first vertical wall, the second vertical wall defining a second in-goal area;

providing a first goal having generally parallel vertical bars and a cross bar extending therebetween disposed adjacent to the first wall;

providing a second goal having generally parallel vertical bars and a cross bar extending therebetween disposed adjacent to the second wall;

providing a first line defining an out of bounds extending between generally opposite ends of the first and second walls and a second line defining an out of bounds extending generally between opposite ends of the first and second walls;

providing a ball;

providing a first team of seven players;

providing a second team of seven players;

the first team taking possession of the ball and advancing the ball within the field of play towards the first in-goal area to score by running with the ball and lateraling or passing the ball backwards to teammates so as to touch the ball onto the first wall defining the first in-goal area and/or drop-kicking the ball through the first goal; and the second team preventing the first team from scoring by tackling a player of the first team in possession of the ball and/or attempting to obtain possession of the ball from the first team so as to advance the ball towards the second wall defining the second in-goal area and/or drop-kicking the ball through the second goal.

7. The method of claim 6, including the step of kicking the ball off to start play, and penalizing the kicking team if the ball is kicked over the opposing first or second wall.

8. The method of claim 7, wherein the penalizing step includes the step of granting the non-kicking team possession of the ball at a mid-field marker of the playing field.

9. A method of playing a game, comprising the steps of:

providing a playing field having a length and width;

providing a first vertical wall extending along the length of the playing field and defining a first in-goal area;

providing an opposing and generally parallel second vertical wall extending along end of the playing field, the second vertical wall defining a second in-goal area;

providing a first goal having generally parallel vertical bars and a cross bar extending therebetween disposed adjacent to the first wall;

providing a second goal having generally parallel vertical bars and a cross bar extending therebetween disposed adjacent to the second wall;

providing a first line defining an out of bounds extending between generally opposite ends of the first and second walls and a second line defining an out of bounds extending generally between opposite ends of the first and second walls;

providing a ball;

providing a first team of players;

providing a second team of players;

kicking the ball off to start play, and penalizing the kicking team if the ball is kicked over the opposing first or second wall by granting the non-kicking team the ball at a predetermined point on the field;

the first team taking possession of the ball and advancing the ball within the field of play towards the first in-goal area to score by running with the ball and lateraling or passing the ball backwards to teammates so as to touch the ball onto the first wall defining the first in-goal area and/or drop-kicking the ball through the first goal; and the second team preventing the first team from scoring by tackling a player of the first team in possession of the ball and/or attempting to obtain possession of the ball from the first team so as to advance the ball towards the second wall defining the second in-goal area and/or drop-kicking the ball through the second goal.

10. The method of claim 9, wherein the field of play is approximately 40 yards in length and approximately 80 yards in width.

11. The method of claim 9, wherein each of the first and second teams has seven players.

12. The method of claim 9, wherein the penalizing step includes the step of granting the non-kicking team possession of the ball at a mid-field marker of the playing field.

* * * * *